United States Patent [19]

Yascheritsyn et al.

[11] 4,186,528

[45] Feb. 5, 1980

[54] MACHINE FOR TREATING SPHERICAL SURFACES OF PARTS WITH MAGNETO-ABRASIVE POWDER

[76] Inventors: Petr I. Yascheritsyn, Leninsky prospekt 18, kv. 102; Faddei J. Sakulevich, pereulok Dalny 3; Leonty A. Olender, ulitsa Ya. Kolasa, 67, kv. 14; Alexandr A. Kosobutsky, ulitsa R. Ljuxemburg, 161, kv. 5, all of Minsk, U.S.S.R.

[21] Appl. No.: 908,672

[22] Filed: May 23, 1978

[51] Int. Cl.[2] ..... B24B 5/00

[52] U.S. Cl. ..... 51/161; 51/7

[58] Field of Search ..... 51/7, 17, 26, 163, 164, 51/156, 161

[56] References Cited

U.S. PATENT DOCUMENTS 3,900,972 8/1975 Rupp ..... 51/156

FOREIGN PATENT DOCUMENTS 403537 4/1974 U.S.S.R. ..... 51/7

488692 1/1976 U.S.S.R. ..... 51/161

508389 5/1976 U.S.S.R. ..... 51/161

*Primary Examiner*—Harold D. Whitehead

*Attorney, Agent, or Firm*—Fleit & Jacobson

[57] ABSTRACT

A machine for treating spherical surfaces of parts with a magnetoabrasive powder held in a magnetic field created in the gap between two magnets comprises a horizontal circular channel acting as one of the magnets and a rotor arranged above the circular channel and carrying spindles around the circumference, the lower end of each spindle being provided with another magnet adapted for holding the workpiece. Each spindle has a mechanism which imparts to it a rotary and, simultaneously, recessional motion, the precession center being located mostly on the line of centers of the generatrix of the circular channel.

2 Claims, 2 Drawing Figures

MACHINE FOR TREATING SPHERICAL SURFACES OF PARTS WITH MAGNETO-ABRASIVE POWDER

The present invention relates to abrasive machining of articles in a magnetic field and more specifically it relates to the machines for treating spherical surfaces of parts with magnetoabrasive powder.

The invention will be most efficient for polishing spherical portions of parts, such as convex lenses made of various materials.

Known in the prior art is a machine for treating spherical surfaces of parts with magnetoabrasive powder.

The prior art machine comprises two electromagnets and the gap between them accommodates the workpiece and a magnetoabrasive powder. The working surface of one of the electromagnets is formed by an even number of spherical sectors of alternating polarity whereas the working surface of the other one is formed by an even number of poles of alternating polarity. One of the electromagnets carries a workpiece, e.g. a thin-walled lens. The other magnet corresponds in shape to the spherical shape of the workpiece and is arranged with a gap from the treated surface of the part. During rotation of one of the magnets the magnetoabrasive powder contained in the gap between the treated spherical surface of the secured workpiece and the other magnet performs a compound motion relative to the treated surface of the workpiece due to the interaction of the fields and thus polishes the surface of the part.

The workpieces are treated in the prior art machine piece by piece and the uniformity of treatment is achieved due to the alternating effect produced by the magnetic fields of the magnet working surfaces on the magnetoabrasive powder located between the workpiece and the magnet.

The prior art machine fails to ensure the adequate uniformity of treatment because the linear velocities of the points of the workpiece located in the different zones of its spherical surface are also different whereas the displacement of the magnetoabrasive powder under the effect of the magnetic fields created by the magnets is at a minimum in the centre of the sphere. As a result, the central zone of the sphere is treated worse than its peripheral portions. Besides, the thickness of the workpiece in the prior art machine is limited by the permissible gap between the working surfaces of the magnets.

An object of the invention resides in stepping up the machine output by ensuring simultaneous treatment of the spherical surfaces of several workpieces on said machine.

Another object of the invention resides in ensuring uniform treatment of the entire spherical surface of the workpiece.

The substance of the invention consists in providing a machine for treating spherical surfaces of parts with magnetoabrasive powder held in a magnetic field created in the gap between two magnets one of which, the first one, carries the workpiece while the shape of the other magnet corresponds to the spherical surface of the workpiece wherein, according to the invention, said other magnet is constituted by a horizontal circular channel whose generatrix is shaped like a portion of a circumference and which is arranged under a rotor 4 which has a drive and carries spindles secured around the circumference above the circular channel, the lower end of each spindle carrying said first magnet adapted for holding the workpiece and each spindle is provided with a means imparting to it simultaneously the rotary and precessional motions with the precession center located mostly on the line of centers of the circular channel generatrix.

The machine according to the invention permits simultaneous treatment of several workpieces which steps up considerably the efficiency of the process; besides, the intensity of treatment is several times higher than that of the prototype machine because the channel contains a large amount of magnetoabrasive powder taking part in the process of cutting.

The machine of the invention ensures a high uniformity of polishing the spherical surface due to the participation of all the points of the sphere in the compound relative movement, including the points located near the axis of rotation.

The means which imparts the rotary and, simultaneously, precessional motion to the spindle may take the form of the rotatable body of the spindle accommodated in the rotor of a rotatable faceplate accommodated in the body of the spindle and provided with an eccentric hole which interacts with the upper end of the spindle which is kinematically linked in the middle with the body by a universal joint lying approximately on the line of centers of the generatrix of the circular channel.

This design of the means for imparting rotary and, simultaneously, precessional motions to the spindle is simple and reliable, rules out vibration of the workpiece and ensures a constant gap between the spherical surface of the part and the working surface of the magnet throughout the process of treatment; besides, it ensures an adequate speed of displacement of the portion of the sphere adjoining the rotation axis of the workpiece which leads to uniform polishing of all the portions of the spherical surface.

Now the invention will be described in detail by way of example with reference to the accompaning drawings, in which.

Figure 1:
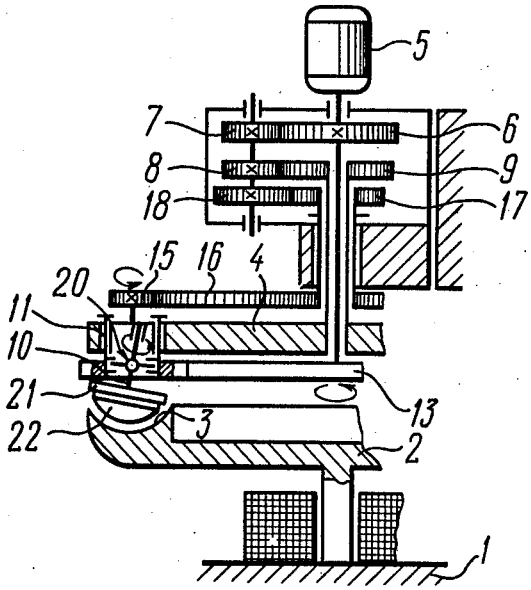
FIG. 1 is a schematic longitudinal section through the machine for treating spherical surfaces of parts with magneto-abrasive powder, according to the invention.

The machine for treating the spherical surfaces of parts with magnetoabrasive powder comprises a frame 1 (FIG. 1) which carries a magnet 2 whose working surface is made in the form of a horizontal circular channel 3 whose generatrix has the shape of a portion of the circumference. Located above the magnet is a rotor 4 coupled to a rotating drive which consists of an electric motor 5 and gears 6, 7, 8, 9. Installed around the circumference of the rotor 4 above the circular channel 3 are spindles 10 (FIGS. 1, 2) provided, each, with a means imparting to it a rotary and, simultaneously, a precessional motion, the precession center being located mostly of the line of centers of the generatrix of the circular channel 3. This means consists of a body 11 accommodated in the rotor 4 and provided with a planet pinion 12 (FIG. 2) which meshes with a sun gear 13 rotated by an electric motor 4, and of a faceplate 14 installed in the body and rotated by a gear 15 rigidly mounted on said faceplate and driven by the electric motor 5 via gears 16, 17, 18, 7 and 6 (FIG. 1). A hole 19 arranged eccentrically on the faceplate 14 (FIG. 2) interacts with the upper end of the spindle 10.

The middle part of the spindle 10 is linked kinematically with the body 11 by a universal joint 20 lying approximately on the line of centers of the generatrix of the circular channel 3.

The lower end of the spindle 10 carries a magnet 21 to which the workpiece 22 is secured.

The machine operates as follows.

Figure 2:
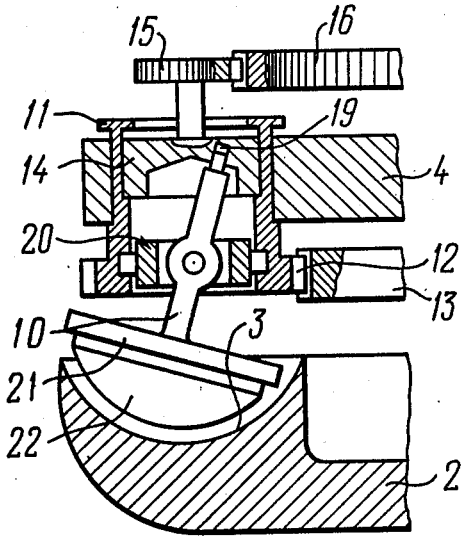
FIG. 2 shows a longitudinal section through the fastening of the spindle in the machine rotor, enlarged.

The workpieces 22 are secured on the magnets 21 of the spindles 10. The magnetoabrasive powder and emulsion are placed into the circular channel 3 of the magnet 2. The electric motor 5 is turned on (FIG. 1) and the workpieces 22 move along the circular channel 3 at the same time rotating around their own axes and performing precessional motion, the precession center coinciding with the center of the universal joint 20 (FIG. 2). When the machine is in the working position the center of the universal joint 20 which is the center of precession must coincide with the center of the spherical surface of the workpiece being treated and be located on the line of centers of the generatrix of the circular channel 3 which ensures a constant gap between the spherical surface of the workpiece 22 and the working surface of the magnet 2 in the course of treatment. This is achieved by the vertical movement of the rotor 4 with the spindles 10.

The above-described compound motion of the workpiece 22 ensures uniformity of treatment of its spherical surface and intensifies the process of treatment.

We claim:

1. A machine for treating spherical surfaces of parts with magnetoabrasive powder in a magnetic field comprising: a circular horizontal channel whose generatrix has the form of a portion of a circumference, said channel serving as a magnet; a rotor arranged above said circular channel; a drive for said rotor; spindles secured around the circumference of said rotor above said circular channel; means for imparting to each of said spindles a rotary and, simultaneously, precessional motion, the precession center lying mostly on the line of centers of the generatrix of the circular channel; a magnet secured on the lower end of each spindle and adapted for fastening a part to be treated to said spindle; and a magnetoabrasive powder contained in said circular channel.

2. A machine according to claim 1 further comprising: a rotatable body of each of said spindles accommodated in said rotor; a rotatable faceplate accommodated in said body and provided with an eccentrically arranged hole; the upper end of said spindle interacting with said hole in the faceplate; a universal joint which links kinematically said body with the middle of said spindle and has a center lying approximately on the line of centers of the generatrix of the circular channel; said body and faceplate linked with the spindle constitute said means for imparting rotary and, simultaneously, precessional motion to the spindle.

* * * * *